United States Patent [19]

Itou et al.

[11] Patent Number: 4,987,338

[45] Date of Patent: Jan. 22, 1991

[54] CATHODE RAY TUBE WITH FILM ON FACE-PLATE

[75] Inventors: Takeo Itou; Hidemi Matsuda, both of Saitama; Hajime Tanaka, Gunma, all of Japan

[73] Assignee: Kabushiki Kaisha Toshiba, Kawasaki, Japan

[21] Appl. No.: 327,733

[22] Filed: Mar. 23, 1989

[30] Foreign Application Priority Data

Mar. 31, 1988 [JP] Japan ..... 63-76255
Jun. 22, 1988 [JP] Japan ..... 63-152259

[51] Int. Cl.[5] ..... H01J 29/88

[52] U.S. Cl. ..... 313/478; 313/479; 313/313

[58] Field of Search ..... 313/466, 477 R, 478, 313/479, 473, 474, 480, 313, 112; 358/250, 253

[56] References Cited

U.S. PATENT DOCUMENTS 4,563,612 1/1986 Deal et al. ..... 313/478
4,728,856 3/1988 Iwasaki et al. ..... 313/467
4,785,217 11/1988 Matsuda et al. ..... 313/479

FOREIGN PATENT DOCUMENTS 57-134848 8/1982 Japan .
57-134849 8/1982 Japan .
57-134850 8/1982 Japan .
57-134851 8/1982 Japan .
61-16452 1/1986 Japan .
61-118946 6/1986 Japan .

*Primary Examiner*—Kenneth Wieder
*Attorney, Agent, or Firm*—Oblon, Spivak, McClelland, Maier & Neustadt

[57] ABSTRACT a cathode ray tube comprises an envelope including a faceplate with an inner and outer surface and an antistatic layer covering the outer surface of the faceplate for discharging static charges accumulating in the faceplate. The antistatic layer is formed by using a solution containing an alcoholate of silicon as main constituent. The antistatic layer contains a stabilizing substance for maintaining antistatic characteristics. The antistatic layer also has light filtering characteristics when the layer contains xanthene dye as filtering substance.

14 Claims, 7 Drawing Sheets

CATHODE RAY TUBE WITH FILM ON FACE-PLATE

BACKGROUND OF THE INVENTION

This invention relates to a cathode ray tube and more particular, to an antistatic layer and a light filtering layer provided in front of a faceplate of the cathode ray tube.

It is known that a cathode ray tube can reproduce letters and pictures by electron beam bombardment of phosphor screen formed on an inner surface of a faceplate of glass. The electron beam is emitted from an electron gun assembly placed inside a neck of an envelope including the faceplate. The phosphor screen includes dot-shaped or stripe-shaped red, green and blue phosphors which are distributed regularly on the inner surface of the faceplate.

The cathode ray tube has a defect that a contrast of the reproduced images is deteriorated under bright ambient light. In order to improve the contrast, modification for reducing the light transmissivity of the faceplate has been generally employed. For example, it has been proposed that a glass plate (neutral filter), which has an almost uniform transmissivity for light in the visible light region, is fitted on the front surface of the faceplate. It, however, is undesirable for the reproduced images to use the neutral filter, since brightness of the reproduced images is reduced in spite of improvement of the contrast. That is, when the transmissivity of the plate is designated as T, brightness of the reproduced images through the faceplate is reduced proportional to the transmissivity T. On the contrary, ambient light reflected to viewers is reduced proportional to $T^2$. Thus, the contrast of the reproduced image is improved. However, it is inevitable to reduce the brightness of the reproduced images.

Another cathode ray tube having a faceplate or a glass plate in front of the faceplate containing neodymium oxide ($Nd_2O_3$) for improving the contrast without reduction of the image brightness has been proposed in U.S. Pat. No. 4,728,856 and Japanese Patent Disclosure No.57-134848, 57-134849 and 57-134850. Since the faceplate and plate containing $Nd_2O_3$ act as a light filter, which has a steep main absorption band at 560 nm ~615 nm and a secondary absorption band at 490 nm ~545 nm, because of selective light absorption characteristics of neodymium oxide, the red and blue color purity of the reproduced images are improved and thus the contrast is improved to some extent.

However, a remarkable improvement of the contrast has not been achieved in the cathode ray tube in spite of utilization of selective light absorption characteristics. Namely, when the contrast improvement of the light filter containing neodymium oxide is evaluated by using BCP (Brightness Contrast Performance) as an index, the BCP of the filter is $1 \leqq BCP \leqq 1.05$. It is clear from the value of the BCP that the contrast is not sufficiently improved. The BCP represents the contrast improvement ratio to the contrast improvement in case of using the neutral filter mentioned above as the standard. And the BCP can be also expressed as $BCP = \Delta B/\sqrt{\Delta Rf}$ the brightness reduction ratio is designated by $\Delta B$ and the reduction ratio of the ambient light reflectivity is designated by $\Delta Rf$.

Also, since the filter containing neodymium oxide has the main absorption band in the wavelength range of 560 nm~615 nm and, moreover, the main absorption band has the steep region, of which width is 5 nm~10 nm in the wavelength region of 560 nm~570 nm, the color of &he glass plate and the faceplate (so called as body color) change due to the ambient light. In particular, the body color becomes red under the ambient light from incandescent lamps. As a result, the parts of the images with low brightness, such as the black color and shadows, take on a reddish tinge, and thus, quality of the images is deteriorated.

Moreover, the cost of the filter increases due to a high cost of neodymium.

The cathode ray tube has another problem due to the glass faceplate. Since the surface resistance of the faceplate is high, static charges due to the electron beam accumulate on the faceplate during tube operation. Because of the accumulation of the static charges, dust and fluff in the atmosphere are absorbed on to the outer surface of the faceplate. Also, when someone touch the faceplate during tube operation, they receive an electrical shock.

In order to solve the problems due to the accumulation of the static charges, it has been proposed that the outer surface of the faceplate is covered with an antistatic layer which can discharge static charges accumulated on the faceplate during tube operation. For example, it is disclosed in U.S. Pat. No.4,563,612 issued on Jan. 7, 1986 that a cathode ray tube has an antistatic, glare-reducing, image-transmitting coating on an external viewing surface of a glass viewing window. The coating has a rough surface for imparting the glare-reducing characteristics and is composed essentially of a silicate material and a metallic compound in proportions to impart the desired antistatic characteristics without substantially degrading the image-transmitting capability of the coating.

Further, it is also disclosed that the formulation may contain pigment particles and/or dyes to reduce the brightness up to about 50 percent of its initial value and/or to modify the spectral distribution of the transmitted image.

However, the coating can not exhibit a satisfactory antistatic effect in practical use. Namely, since the silicate material composing the coating substantially has no conductivity, resistance value of the coating is not sufficiently reduced even if the small amount of metal compounds are contained in the coating. Further, when the amount of the compound added is increased to reduce the resistance value, strength and optical characteristics of the coating are deteriorated.

Another cathode ray tube for solving the accumulation of the static charges is disclosed in Japanese Patent Disclosure No. 61-118946. An outer surface of a faceplate is covered with double layers, which consists of an antireflection layer and an antistatic layer formed on the antireflection layer. The antireflection layer consists of transparent $SiO_2$ and has rough surface for improving the contrast of the reproduced images. The antistatic layer is formed on the outer surface of the faceplate by spraying a solution which contains an alcoholate of silicon as its main constituent and contains silanole radical.

Since the antistatic layer can absorb moisture in the atmosphere due to the silanole radical, the resistance value of the layer can be effectively reduced. However, when using the antistatic layer, the silanol radical is reduced with the passage of time through the progressive glassification of the silicon forming the basis of the layer. Because of reduction of the silanol radical, the resistance value of the layer increases in accordance with reduction of the moisture absorption capability. As a result, antistatic effect is deteriorated. Accordingly, the antistatic layer lacks stability of antistatic characteristics.

SUMMARY OF THE INVENTION

An object of this invention is to provide a cathode ray tube with a thin layer provided in front of a faceplate for improving reproduced images.

Another object of the invention is to provide a cathode ray tube with an excellent light filter provided in front of the faceplate for improving contrast of the reproduced images.

Further object of the invention is to provide a cathode ray tube with an excellent antistatic layer having a stable antistatic characteristics.

Therefore, the invention may provide a cathode ray tube comprising an envelope including a faceplate with an inner and outer surfaces and a sidewall portion; a neck, and a cone connecting the faceplate to the neck; an electron gun provided inside the neck for emitting at least one electron beam; a phosphor screen provided on the inner surface of the faceplate for emitting a visible light by bombardment of the electron beam; and a thin layer provided on the outer surface of the faceplate for preventing from accumulation of static charges on the faceplate. The thin layer is formed by a solution which contains an alcoholate of silicon as main consistent and a stabilizing substance presence in operative concentrations for maintaining antistatic characteristics of the layer.

The invention may also provide a cathode ray tube comprising an envelope including a faceplate with an inner and outer surfaces and a sidewall portion, a neck, and a cone connecting the faceplate to the neck; an electron gun provided inside the neck for emitting at least one electron beam; a phosphor screen provided on the inner surface of the faceplate for emitting a visible light by bombardment of the electron beam; and light filtering means provided in front of the faceplate. The light filtering means has maximum absorption wavelength in wavelength range of 575±20 nm in connection with wavelength range from 400 nm to 650 nm and is satisfied with the relationship of $T_{min} \leqq T_{550} < T_{530}$, $1 \leqq T_{450}/T_{530} \leqq 2$, $1 \leqq T_{630}/T_{530} \leqq 2$, and $0.7 \leqq T_{450}/T_{630} \leqq 1.43$ wherein $T_{450}$, $T_{530}$, $T_{550}$, $T_{630}$, and Tmin represent transmissivities for lights of wavelength of 450 nm, 530 nm, 550 nm, 630 nm, and the maximum absorption wavelength, respectively.

According to the invention, since the thin layer for preventing from accumulation of static charges contains the stabilizing substance, the resistance value of the antistatic layer does not increase with the passage of time. Accordingly, a stable antistatic layer is obtained.

This fact can be considered as follows. The antistatic layer, which is formed by using a solution of an alcoholate of silicon, is composed of a $SiO_2$ film partially having a silanol radical. In the conventional antistatic layer, the silanole radical will cause a dehydrating condensation reacting with passage of time, and thus, moisture absorption capability due to the silanole radical will disappear through the glassification of the layer.

On the contrary, since the antistatic layer of the invention contains stabilizing substance, the glassification mentioned above can be effectively prevented. It is assumed that the stabilizing substance is present in such a way that it separates neighboring silano radicals and thus prevents the reaction of the silanol radicals in the layer. As a result, the dehydrating condensation reaction can be prevented and thus the increase in the resistance value of the layer with the passage of time can be prevented.

The stabilizing substance is an organic substance, which is solid at normal temperature, can be dissolved in water or an organic solvent such as alcohol, and has a molecular weight of 100 to 5000. For example, dyes, such as anthraquinone group dyes composed of anthraquinone and its derivatives, azo group dyes and carbonium dyes, can be used. Another dyers, such as xanthene dyes and phthalein dyes including Sulpho Rhodamine B (color Index 45100) and Rhodamine B (color Index 45170), Kayanol Milling Red 6BW(Aoid Violet 97),and Kayaset Blue K-FL (Solvent Blue 70), can be used as the stabilizing substance. These dyes of Sulpho Rhodamine B. Rhodamine B. Kayanol Milling Red 6BW and Kayaset Blue K-FL are marketed by Nippon Kayaku Co., Ltd.

Amount of the stabilizing substance in the antistatic layer can be adjusted depending on the molecular weight and specific gravity of the substance. The amount of the substance is preferably between 0.01 wt % and 75 wt %. If the amount falls sort of the value, prevention of deterioration of the antistatic layer can not be expected. Also, if the amount exceeds, transmissivity and adhersion of the layer is reduced for practical use.

The antistatic layer of this invention can contain metal salts, such as Li, Na, Ba, Sr and Ca, as moisture absorbent.

The present inventors found that the antistatic layer, which contained a small amount of particular dyes, acted as a light filter having an excellent light filtering characteristics for improving the contrast of the reproduced images of the cathode ray tube. Namely, the inventors developed a new light filter based on a complete new concept. The filter took into account the radiation spectrum of the light emitted from the phosphor screen of the cathode ray tube and spectral luminous efficacy characteristics, and had the optimum light absorption characteristics for the cathode ray tube.

They found the reason for slight contrast improvement of the glass plate containing $Nd_2O_3$ with BCP of $1 \leqq BCP \leqq 1.05$ in spite of the selective absorption filter. As shown in FIG. 1, the glass plate as the light filter had high transmissivity near the wavelength of 550 nm where the spectral luminous efficacy characteristics is highest, but near the radiation peak of the green light at wavelength of 530 nm, the transmissivity was lower on the contrary. Finally, the inventors developed the optimum light filter for the cathode ray tube by adjusting the transmissivity of each characteristic wavelength in the relationship between the radiation spectrum characteristics of the phosphor screen of the cathode ray tube and spectral luminous efficacy characteristics.

The light filter according to the invention has maximum absorption wavelength in wavelength range of 575±20 nm is connection with wavelength range from 400 nm 650 nm and satisfies following equations (1) to (4).

$$T_{min} \leqq T_{550} < T_{530} \quad (1)$$

$$1 \leqq T_{450}/T_{530} \leqq 2 \quad (2)$$

$$1 \leqq T_{630}/T_{530} \leqq 2 \quad (3)$$

$$0.7 \leqq T_{450}/T_{630} \leqq 1.43 \quad (4)$$

In the equations, $T_{450}$, $T_{530}$, $T_{550}$, $T_{630}$ and Tmin represent transmissivity for lights of wavelength of 450 nm, 530 nm, 550 nm, 630 nm and the maximum absorption wavelength, respectively.

The following is an explanation of the operation of the light filtering layer used in the cathode ray tube of this invention. In FIG. 2, emission spectra of the typical phosphors for emitting blue (ZnS: Ag, Cl phosphor), green (ZnS: Cu, Al phosphor) and red : ($Y_2O_2S:Eu^{3+}$ phosphor) used in the phosphor screen of the cathode ray tube are shown. Also, FIG. 3 shows the spectral distribution (a), the luminosity curve (b) and the product of the spectral distribution and the luminosity curve (C), when the light from a fluorescent lamp is taken as the ambient light. As can be seen from the graphs, the ambient light can be most efficiently absorbed near the peak of the curve (C), namely, light of the wavelength 575 nm±20 nm can be interrupted. However, at the same time, every effort must be made to avoid a reduction in brightness. Consequently, the characteristics of the light filtering layer has the maximum transmissivity, in other words, maximum ambient light absorption efficiency near 450 nm and 630 nm where the luminosity is lowest and emission energy is large, the minimum transmissivity, in other words, increased luminosity near 575 nm where the emission energy of the phosphor is small, and an intermediate transmissivity near 530 nm where emission energy of green phosphor is peak. In addition, the transmissivity of the filtering layer between 530 nm and 575 nm is smaller than the transmissivity at 530 nm, since energy of the ambient light near 550 nm is larger than energy of the ambient light at 530 nm, and emission energy of green phosphor is small. That is to say, if the filtering characteristics is taken as satisfying $Tmin \leqq T_{550} < T_{530}$, and $T_{530} \leqq T_{630}$, the maximum efficiency for contrast improvement can be obtained.

Regarding the body color of the light filtering layer, there are cases of its becoming of a slightly reddish tinge when an incandescent lamp is used as the ambient light. However, the body color can be corrected. FIG. 4 shows the spectral distribution d, the luminosity curve (e) and the product of the spectral distribution and the luminosity curve (f) in the case of ambient light from the incandescent lamp. As seen from the FIG. 4, the longer the wavelength of the light, the greater the emission energy of the light. Consequently, the body color can be corrected by adjusting the transmissivity of the filtering layer in the region of 650 nm~700 nm, where the reddish tinge is stronger, to be smaller than the transmissivity near 630 nm, where the emission energy of red phosphor.

In detail, the body color of the faceplate could be corrected by adjusting the characteristics of the filtering layer according to the invention for satisfying following equations (5) to (7).

$$T_{450}/T_{530} = 1 \sim 2 \quad (5)$$

$$T_{630}/T_{530} = 1 \sim 2 \quad (6)$$

$$T_{450}/T_{630} = 0.7 \sim 1.43 \quad (7)$$

In the above relationships, if the value of equation (5) exceeded 2 or the value of equation (7) exceeded 1.43, the body color showed a strong bluish tinge. If the value of equation (6) exceeded 2 or the value of equation (7) fell below 0.7, the body color showed a strong reddish tinge which was not practical. Furthermore, if the values of the equations (5) and (6) fell below 1, the filter was not practical since the contrast improvement reduced and the BCP value was small.

The light filter of the invention contains xanthene dyes and phthalein dyes including Sulpho Rhodamine B (color Index 45100) and Rhodamine B(color Index 45170) with following formular, respectively, and Kayanol Milling Red 6BW (Acid Violet 97) for representing above mentioned filter characteristics.

Sulpho Rhodamine B

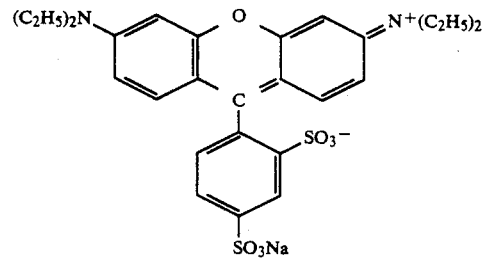

Rhodamine B

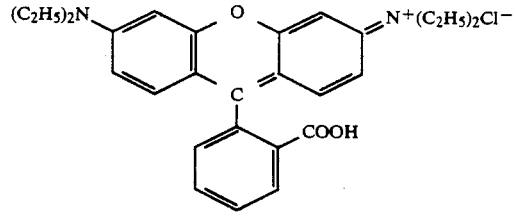

In order to correct the body color mentioned above, the filter of this invention preferably contained another dyes in addition to the dyes mentioned above, such as Kayaset Blue K-FL (Solvent Blue 70) marketed by Nippon Kayaku Co., Ltd. which has maximum absorption wavelength at wavelength of 675 nm and near infra-red absorption agents of a type which have a near infra-red absorption, for example, a maximum absorption wavelength at 675 nm and the end of the light absorption extending to the range of wavelength between 650 nm and 700 nm.

The filter of this invention preferably contained from 2.0 g to 0.02 g of dyes for satisfying the basic relationship shown by the equations (1) to (4).

Furthermore, not only dyes, but also pigmenes, and particularly organic pigment can be used for the filter.

In the color cathode ray tube of the invention, a value of BCP of the light filter increased up to 1.05~1.50, which varied according to radiation spectrum of the phosphor screen and the concentration of the filter material, such as dye, and thus an excellent contrast characteristics can be obtained.

The light filtering layer of this invention can be formed by coating a solution, which are prepared by mixing suitable dyes and pigments with the selective light transmissivities mentioned above into an alcohol solution containing ethyl silicate as main constituent, directly on the faceplate of the cathode ray tube using suitable method, such as spin coating method or spray method. Also, the light filtering layer can be obtained by producing a filtering plate composed of a transparent base plate, such as acrylic resins, and dyes and/or pigments which are contained in the plate. The filtering plate can be attached to the faceplate. Furthermore, in the case of telepanel cathode ray tubes, the filtering layer can be formed by mixing the dyes into the adhesive resins, which are used for sticking the telepanel acting as a color at the faceplate.

DETAILED DESCRIPTION OF PREFERRED EMBODIMENT

Figure 1:
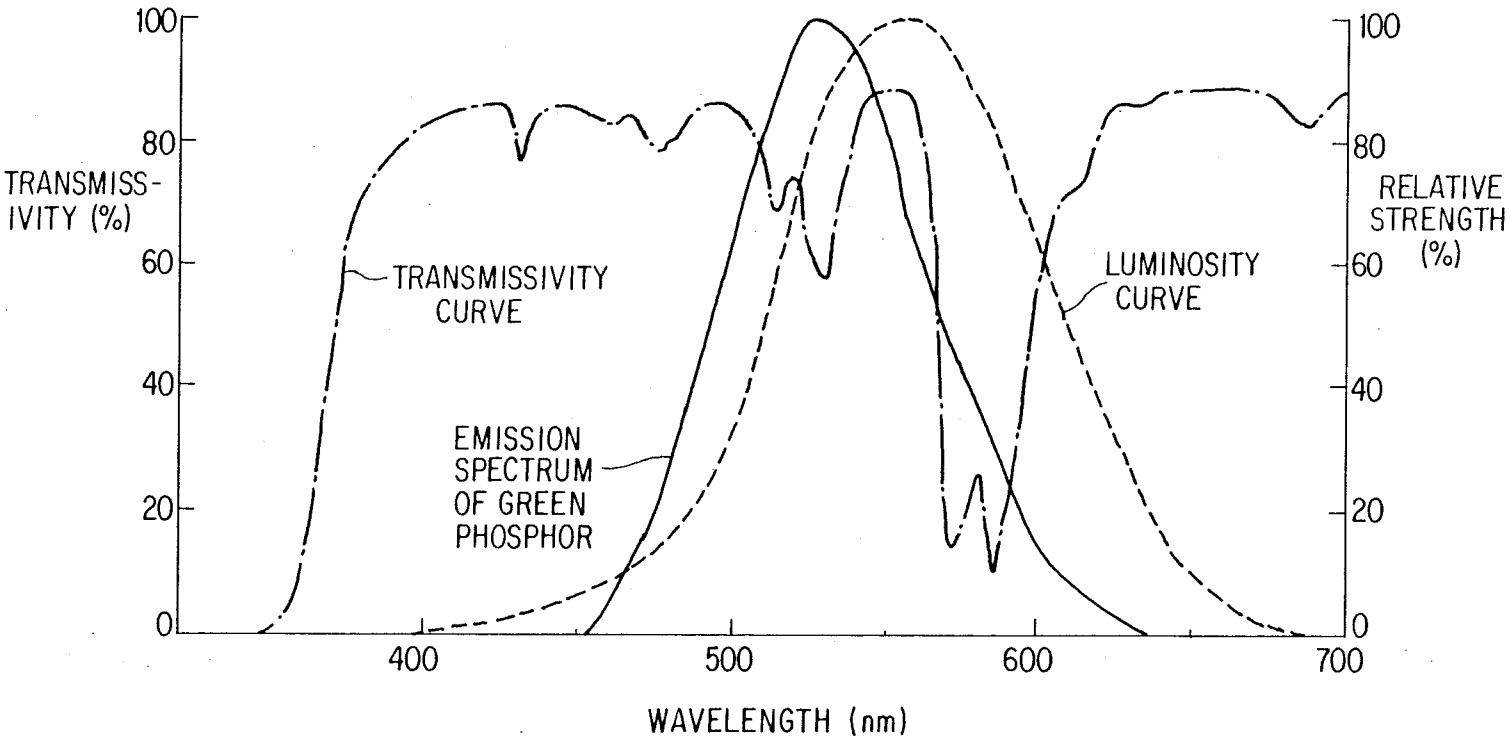
FIG. 1 PRIOR ART
FIG. 1 is a graph showing a transmissivity curve, a luminosity curve of a conventional light filter containing neodymium oxide and the spectral characteristics of the green phosphor shown in FIG. 2.
Figure 2:
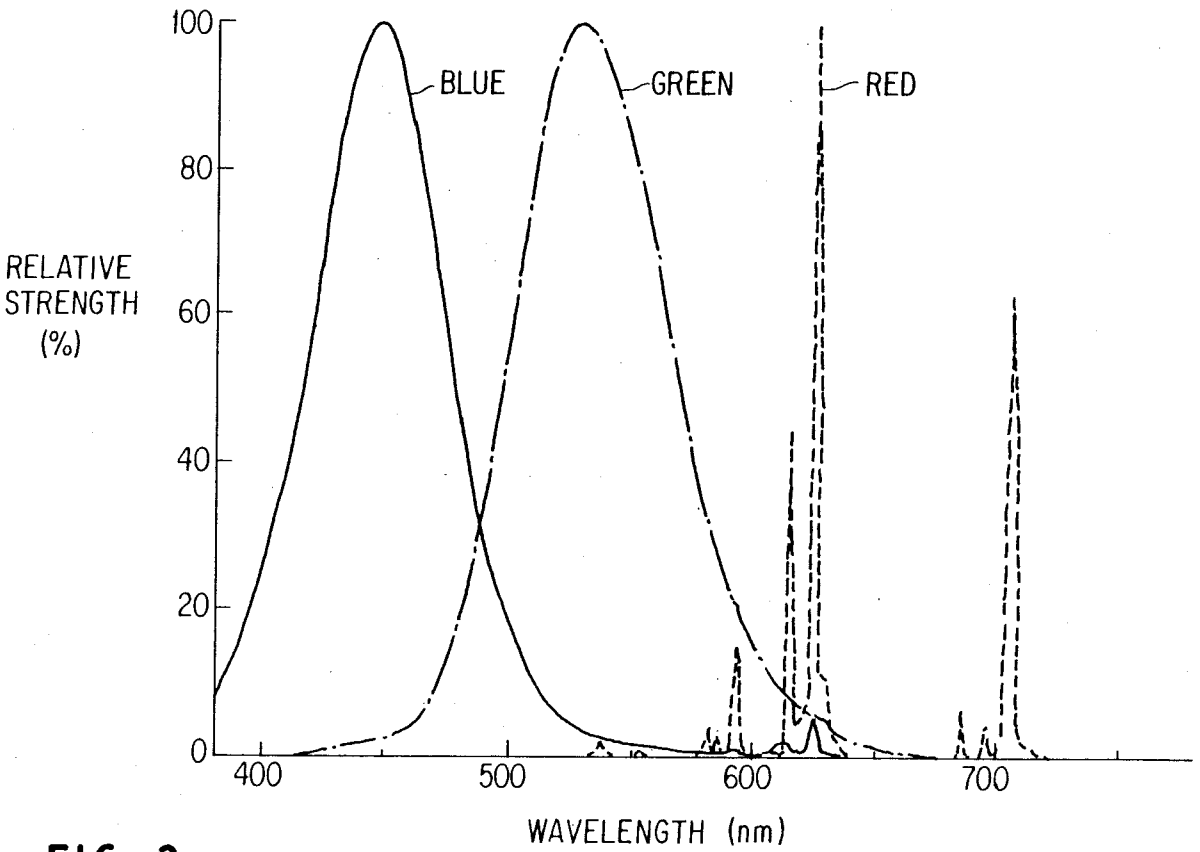
FIG. 2 PRIOR ART
FIG. 2 is a graph showing the emission spectra of typical blue, green and red phosphors used for the phosphor screen of the cathode ray tube.
Figure 3:
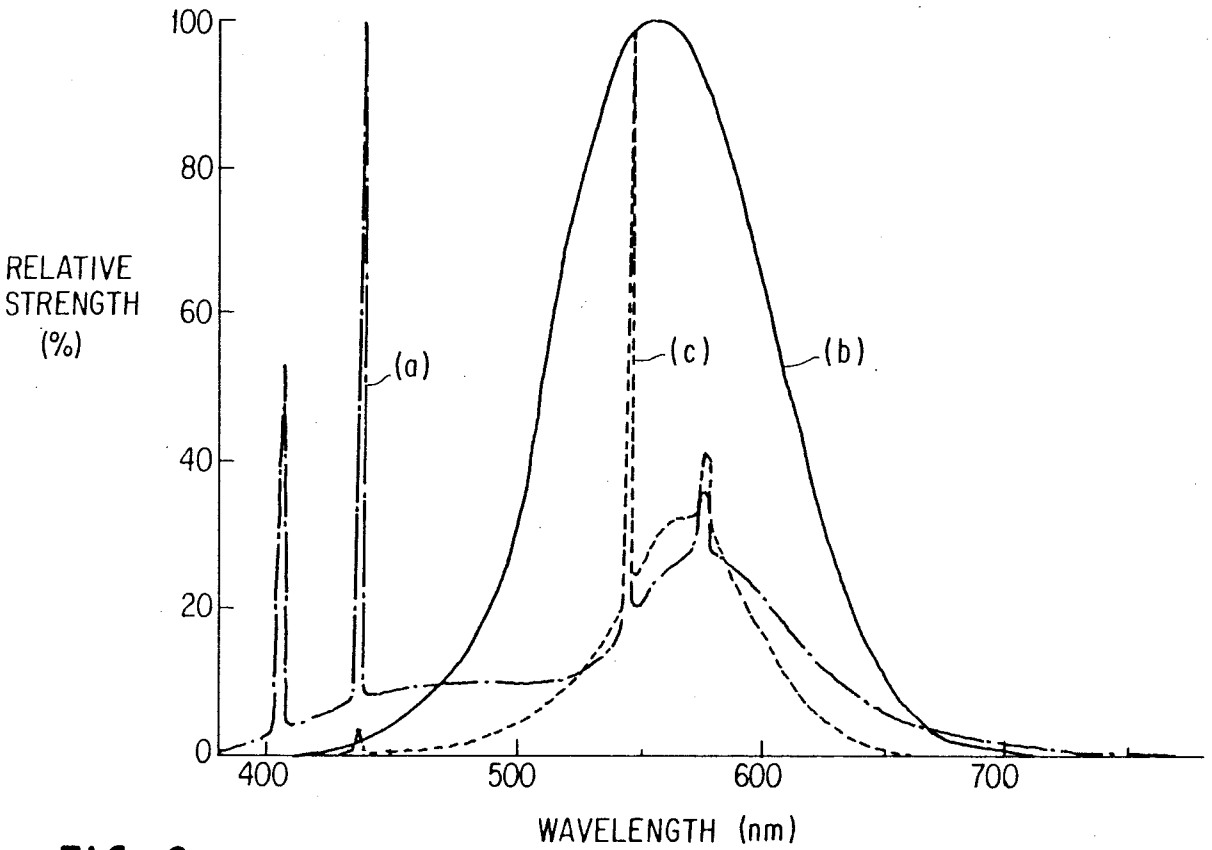
FIG. 3 PRIOR ART
FIG. 3 is a graph showing spectral characteristics, a luminosity curve and the product of the spectral characteristics and the luminosity Curve for a typical fluorescent lamp.
Figure 4:
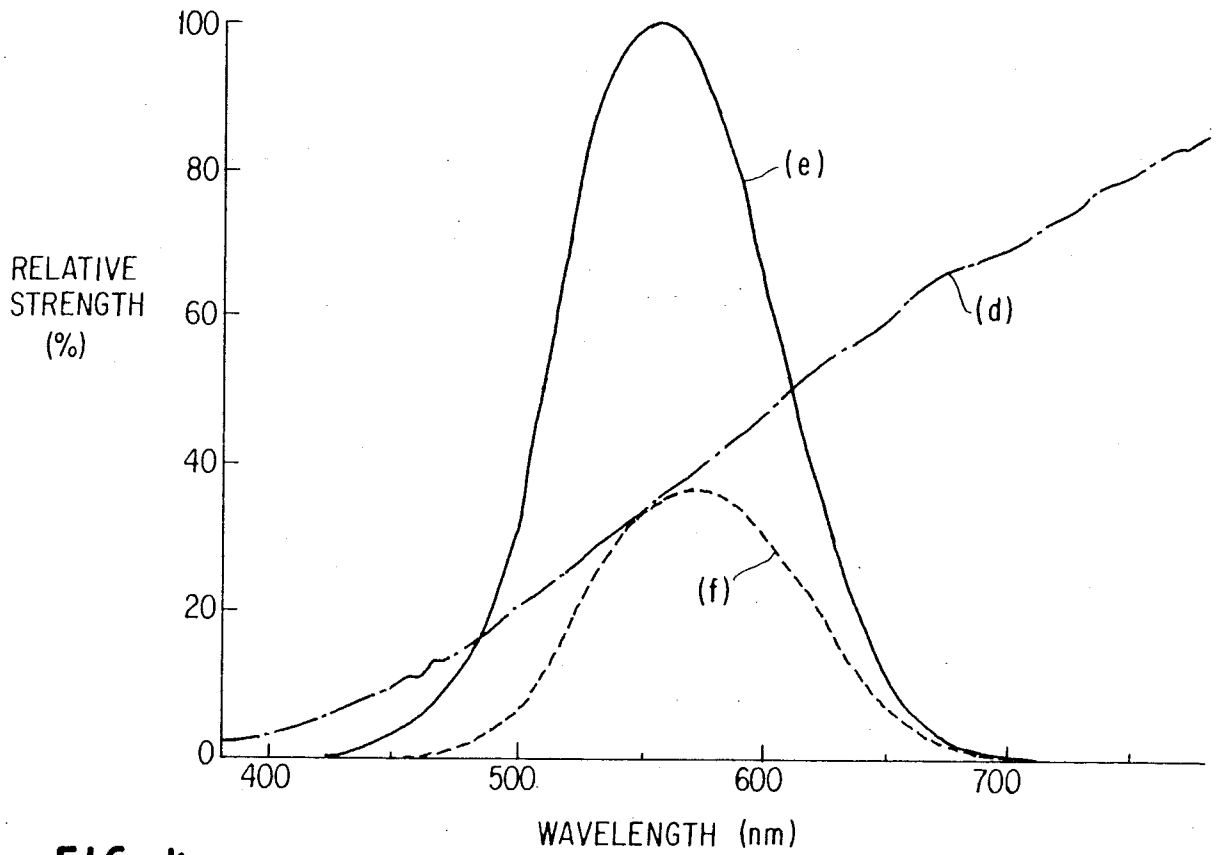
FIG. 4 PRIOR ART
FIG. 4 is a graph showing spectral characteristics, a luminosity curve and the product of the special characteristics and the luminosity curve for a typical in candescent lamp.
Figure 5:
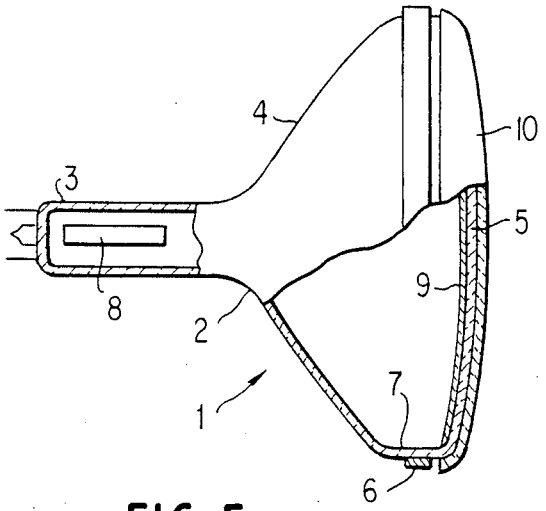
FIG. 5 shows a side view of a cathode ray tube in accordance with one embodiment of the invention.

Preferred embodiment of this invention will be explained with reference to the drawings. In FIG. 5, a cathode ray tube 1 includes an envelope 2 which is hermetic and is made of glass. The envelope 2 has a neck 3 and a cone 4 in continuation to the neck 3. The envelope 2 also has a faceplate 5 sealed with the cone 4 by frit glass. A metal tension band 6 for preventing explosion is wound around the outer periphery of a sidewall portion 7 of the faceplate 5. An electron gun 8, which emits three electron beams, is provided in the neck 3. On the inner surface of the faceplate 5, there is provided a phosphor screen 9 which consists of a plurality of phosphor stripes for emitting red, green and blue lights and light absorbing stripes between the phosphor stripes. A shadow mask (not shown), which has a plurality of apertures for bomberding the phosphor stripes by the electron beams, is placed adjacent to the phosphor screen 9. A deflection yoke (not shown) is attached to the outside of the cone 4 for deflecting the electron beams to scan the phosphor screen 9.

Figure 6:
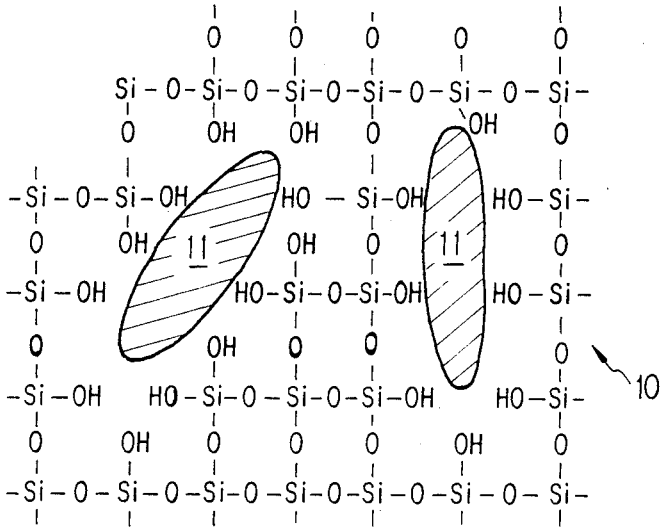
FIG. 6 is an enlarged diagram showing a part of molecular structure of an antistatic layer shown in FIG. 5.

The outer surface of the faceplate 5 is covered with an antistatic layer 10 to reduce the surface resistance of the faceplate 5. As shown in FIG. 6, the antistatic layer 10 contains stabilizing substances 11, which is composed of methyl violet and separates the silanol radicals. Although the antistatic layer 10 is shown as a two-dimensional structure in FIG. 6, the actual antistatic layer is expanded to three dimension.

Since the antistatic layer 10 contained the stabilizing substances 11 separating the silanol radicals, the resistance value of the antistatic layer 10 did not increase with the passage of time and the antistatic layer 10 could maintain a stable antistatic characteristics. Also, since the antistatic layer 10 contained methyl violet as the stabilizing substances, the external light reflectivity was reduced by 20% and the contrast was also improved.

The antistatic layer 10, of course, was electrically connected to the metal band 6 to effectively discharge the static charges which would be accumulated on the faceplate 5.

The antistatic layer was formed as follows.

EMBODIMENT 1

A coating solution having the following composition was prepared.

| | |
|---|---|
| Ethyl silicate | 7 wt % |
| Hydrochloric acid | 3 wt % |
| Methyl violet | 0.2 wt % |
| Water | 2 wt % |
| Isopyl alcohol | Remainder |

The solution was coated on the outer surface of the faceplate of the assembled cathode ray tube by spin coating method. After coating, the antistatic layer was formed by drying.

The resistance valve of the layer was $5\times10^9$ Ωcm, as the result of measurement. A heat-resistance test was carried out by leaving the cathode ray tube with the antistatic layer for 500 hours at a temperature of 80° C. to evaluate the stability of the antistatic layer with the passage of time. As the result of the test, the resistance value did not increase more than $5\times10^{10}$ Ωcm, and the antistatic layer had a satisfactory antistatic characteristics.

On the contrary, after the heat-resistance test mentioned above, an antistatic layer which did not contain the stabilizing substance was deteriorated in accompany wit increase of the resistance value from $5\times10^9$ Ωcm to $1\times10^{13}$ Ωcm.

EMBODIMENT 2

An antistatic layer according to another embodiment contained lithium chloride as a moisture absorbent in addition to violet dye as the stabilizing substance.

A coating solution having the following composition was prepared.

| | |
|---|---|
| Ethyl silicate | 7 wt % |
| Hydrochloric acid | 3 wt % |
| Lithium chloride | 1 wt % |
| Violet dye | 0.2 wt % |
| Water | 2 wt % |
| Isopropyl alcohol | Remainder |

The solution was coated on the outer surface of the faceplate of the assembled cathode ray tube by spin coating method. After coating, the antistatic layer was formed by drying.

The resistance value of the layer was $1\times10^8$ Ωcm, as the result of measurement. As mentioned above, a heat-resistance test was carried out under the same conditions. After the test, the resistance value did not increase more than $1\times10^{9}$ Ωcm, and this result meant that the antistatic layer had a satisfactory antistatic characteristics.

EMBODIMENT 3

An antistatic layer according to the other embodiment contained saccharin with a molecular weight of 183 as the stabilizing substance.

A coating solution having the following composition was prepared.

| | |
|---|---|
| Ethyl silicate | 7 wt % |
| Hydrochloric acid | 3 wt % |
| Saccharin | 0.2 wt % |
| Water | 2 wt % |
| Isopropyl alcohol | Remainder |

The solution was coated on the outer surface of the faceplate of the assembled cathode ray tube by spin coating method. After coating, the antistatic layer containing the stabilizing substance of saccharin was formed by drying.

The resistance value of the layer was $5\times10^9$ Ωcm, as the result of measurement. A heat-resistance test was carried out under the same condition mentioned above. After the test, the resistance value did not increase more than $5\times10^{10}$ Ωcm. This result meant that the antistatIc layer had an excellent stability.

According to the other embodiment of the invention, an antistatic layer with not only antistatic characteristics but also light filtering characteristics is explained. In other words, the antistatic layer is a light filtering layer with antistatic characteristics by containing filtering substance of particular organic dyes which can act as the stabilizing substance for maintaining antistatic characteristics.

EMBODIMENT 4

A coating solution having the following composition was prepared.

| | |
|---|---|
| Ethyl silicate ($Si(OC_2H_5)_4$) | 7 g |
| Hydrochloric acid (HCl) | 3 g |
| Water | 2 g |
| Sulpho Rhodamine B | 0.O2 g~4.0 g |
| Isopropyl alcohol | Remainder |

The solution was coated on the outer surface of the faceplate with a size of 25 inches by spin coating method after assembling the cathode ray tube. After coating, a light filtering layer, which contained the light filtering substance acting as the stabilizing substance for maintaining antistatic characteristics, was formed by drying. In the case of the embodiment, the amount of Sulpho Rhodamine B contained in the filtering layer was 4.0 g, 2.0 g, 1.5 g, 1.0 g, 1.5 g, 0.3 g, 0.1 g, 0.5 g, and 0.02 g. Transmissivity curves of the light filtering layer, which contained 4.0 g, 2.0 g, 1.0 g, 0.5 g and 0.3 g of Sulpho Rhodamine B, were shown by the curves (A), (B), (C), (D), and (E) in FIG. 7, respectively.

In Table 1, a result of evaluation regarding the reproduced images obtained from the cathode ray tubes with the light filtering layers and a result of the heat-resistance test carried out under the same conditions mentioned above were shown. As a comparison, a 25-inch-size cathode ray tube, which has a glass plate containing $Nd_2O_3$ as the light filter, was evaluated. In Table 1, the body color was evaluated whether, when black images were reproduced by these color cathode ray tubes, the images were recognized by human sight as natural black without the black being tinged with any other color. In practice, a black pattern of 50 mm×50 mm was reproduced in the center of the phosphor screen, and the periphery of the pattern was made white. The sade of the black pattern (reddish, bluish, green, etc.) was evaluated while illuminating the faceplate with an incandescent lamp from an angle of 45° with respect to the outer surface of the faceplate so that the illumination on the outer surface of the faceplate was 500 lux. Evaluation standard was that the case of recognition as natural black without being tinged by any color was indicated as ⊙, the case of noticing slight coloration but hardly any problem was indicated as ○, the case of coloration being rather strong and tending to cause problems was indicated as Δ, and the case of the coloration being so strong that the pattern was not as black was indicated as x.

TABLE 1

| Amount of Sulpho Rhodamin B (g) | 4.0 | 2.0 | 1.5 | 1.0 | 0.5 | 0.3 | 0.1 | 0.05 | 0.02 | Glass Filter Containing $Nd_2O_3$ |
|---|---|---|---|---|---|---|---|---|---|---|
| B C P | 1.70 | 1.47 | 1.39 | 1.25 | 1.14 | 1.06 | 1.01 | 1.00 | 1.00 | 1.02 |
| Resistance Value After Heat-Resistance Test (Ωcm) | $5\times10^{11}$ | $1.5\times10^{11}$ | $5\times10^{10}$ | $5\times10^{10}$ | $4.5\times10^{10}$ | $4.5\times10^{10}$ | $3\times10^{10}$ | $3.5\times10^{10}$ | $5\times10^{10}$ | |
| Body Color | x(red) | ○ | ○ | ⊙ | ⊙ | ⊙ | ⊙ | ⊙ | ⊙ | x(red) |

As seen from Table 1, if the amount of the dye was increased, the BCP increased and the contrast was improved. However, the body color gradually became more strongly tinged. When the amount of the dye was 4.0 g, $T_{450}/T_{530}$ and $T_{630}/T_{530}$ were 3.57 and exceed 2, respectively, and it could not be used, practically. In connection with the body color evaluation, the dye could be contained up to 3.0 g. And, in these cases, $T_{450}/T_{530}$ and $T_{630}/T_{530}$ was 1.9 2.0. Also, the BCP was 1.47 in these cases, and a great improvement in contrast was observed.

As also seen from Table 1, if the amount of the dye was between 0.3 g and 4.0 g, the contrast was improved, and if the amount of the dye was between 0.2 g and 1.5 g, antistatic characteristics of the filtering layer was stabilized. Further, if the amount was between 0.3 g and 1.5 g, the filtering layer which has no problem of body color, improved contrast, and stable antistatic characteristics was obtained.

EMBODIMENT 5

The filtering layer of this embodiment further contained 1 wt % of LiCl as moisture absorbent for improving antistatic characteristics, comparing to the filtering layer of Embodiment 4.

Table 2 shows the result of heat-resistance test carried out under the same conditions mentioned above.

TABLE 2

| | | | | | | | | | |
|---|---|---|---|---|---|---|---|---|---|
| Amount of Sulpho Rhodamin B(g) | 4.0 | 2.0 | 1.5 | 1.0 | 0.5 | 0.3 | 0.1 | 0.05 | 0.02 |
| Resistance Value After Heat-Resistance Test (Ωcm) | $1 \times 10^{10}$ | $4.5 \times 10^{9}$ | $1 \times 10^{9}$ | $9 \times 10^{8}$ | $1 \times 10^{9}$ | $8 \times 10^{8}$ | $9 \times 10^{8}$ | $8.5 \times 10^{8}$ | $1 \times 10^{9}$ |

As seen from Table 2, the filtering layer had stabilized antistatic characteristics.

EMBODIMENT 6

Figure 8:
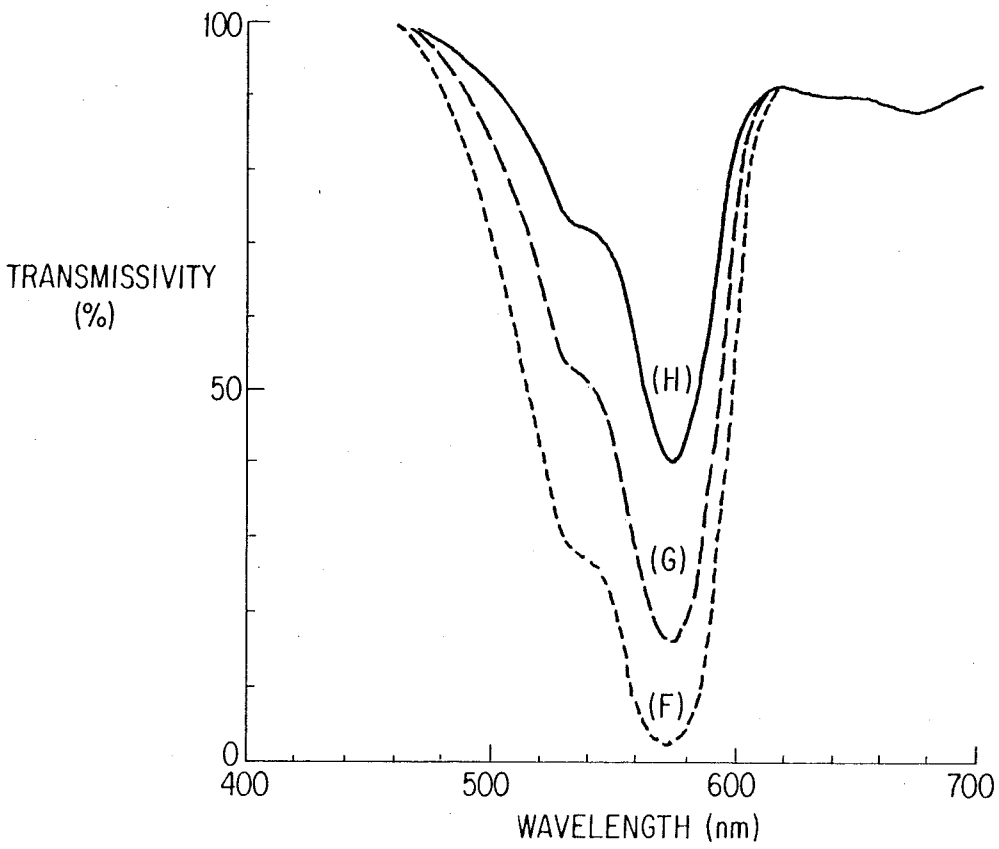
FIG. 8 is a graph showing a transmissivity curve of a light filtering layer according to the other embodiment of the invention.

The light filtering layer of this embodiment further contained dye Kayaset Blue K-FL, which had a maximum absorption wavelength near 675 nm wavelength for correcting the body color. The filtering layers were same as the filtering layers, which contained 4.0 g, 2.0 g and 1.0 g of Sulpho Rhodamin B and had color tones in Embodiment 5, except that the filtering layers of Embodiment 6 contained 0.2 g of Kayaset Blue K-FL. Transmissivity curves of the filtering layer was shown as curves (F), (G), and (H) in FIG. 8. Table 3 shows the result of evaluation of cathode ray tubes with these filtering layers of the embodiment.

TABLE 3

| | | | |
|---|---|---|---|
| Amount of sulpho Rhodamin B (g) | 4.0 | 2.0 | 1.0 |
| Amount of Kayaset Blue K-FL (g) | 0.2 | 0.2 | 0.2 |
| B C P | 1.64 | 1.41 | 1.21 |
| Body Color | Δ | ○ | ◐ |

As seen from Table 3, the BCP was slightly smaller than that of Embodiment 5 because the transmissivity near 630 nm, which was emission energy of the red phosphor, slightly reduced. However, the body color clearly was improved, so that these filtering layer could be practically used.

EMBODIMENT 7

Figure 7:
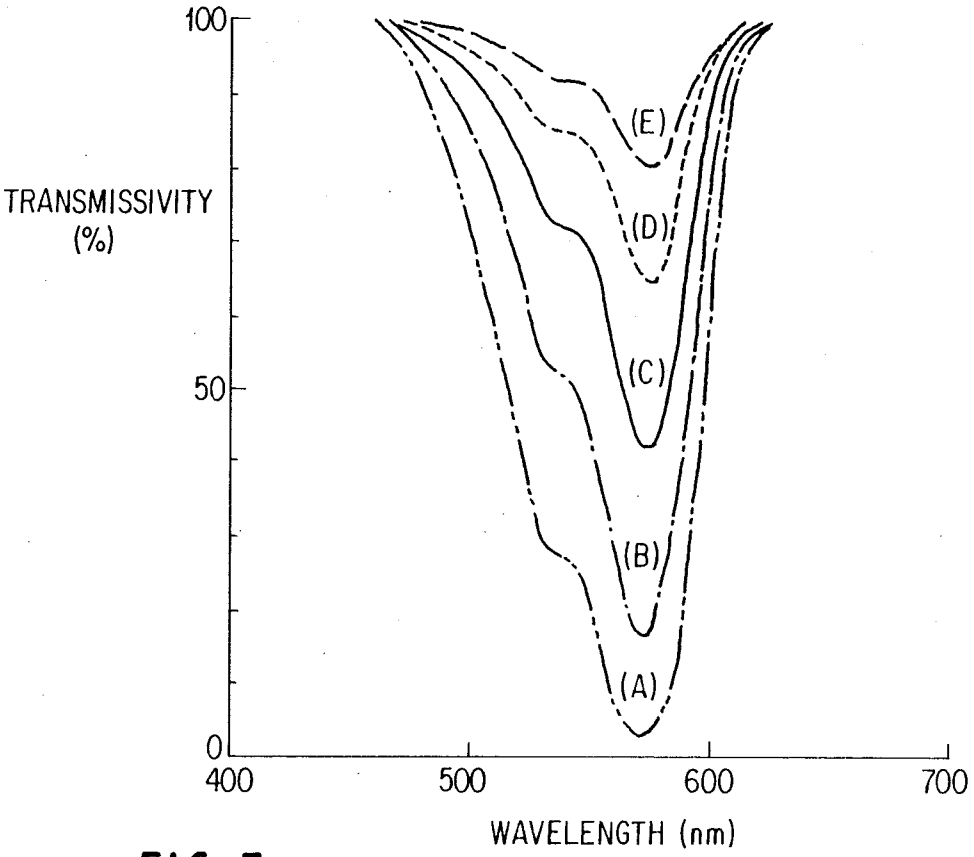
FIG. 7 is a graph showing a transmissivity curve of a light filtering layer according to another embodiment of the invention.

Filter plates of acrylic resins were produced by mixing the same amounts of Slpho Rhodamine B as in Embodiment 5 into acrylic resins. The filter plates were attached to the outer surface of the faceplate, respectively. These cathode ray tubes with the filter plates had the same transmissivity curves as shown in FIG. 7. Also, the same result as in Embodiment 5 were obtained. The filter plates did not have antistatic characteristics.

What is claimed is:

1. A cathode ray tube comprising:

an envelope including a face-plate with an inner and outer surfaces and a sidewall portion, a neck, and, a cone connecting the faceplate to the neck;

an electron gun provided inside the neck for emitting at least one electron beam;

a phosphor screen provided on the inner surface of the faceplate for emitting a visible light by bombardment of the electron beam; and, an antistatic layer covering the outer surface of the faceplate, the antistatic layer being formed by using a solution containing an alcoholate of silicon as main constituent and a stabilizing substance present in operative concentrations for maintaining antistatic characteristics of the antistatic layer wherein the stabilizing substance is organic material which is soluble in water or organic solvent and has molecular weight in the range from 100 to 5000.

2. A cathode ray tube according to claim 1 wherein the antistatic coating contains 0.01 wt % to 75 wt % of stabilizing material.

3. A cathode ray tube according to claim 1 wherein the antistatic coating containing moisture absorbent present in operative concentrations for promoting antistatic characteristics of the antistatic coating.

4. A cathode ray tube comprising:

an envelope including a face-plate with an inner and outer surfaces and a sidewall portion, a neck, and, a cone connecting the faceplate to the neck;

an electron gun provided inside the neck for emitting at least one electron beam;

a phosphor screen provided on the inner surface of the faceplate for emitting a visible light by bombardment of the electron beam; and, an antistatic layer covering the outer surface of the faceplate, the antistatic layer being formed by using a solution containing an alcoholate of silicon as main constituent and a stabilizing substance present in operative concentrations for maintaining antistatic characteristics of the antistatic layer wherein the stabilizing substance is at least one selected from the group consisting of anthraquinone group dyes comprised of anthraquinone and its derivatives, azo group dyes, carbonium dyestuffs, xanthene dyes and phthalein dyes.

5. A cathode ray tube comprising:

an envelope including a face-plate with an inner and outer surfaces and a sidewall portion, a neck, and, a cone connecting the faceplate to the neck;

an electron gun provided inside the neck for emitting at least one electron beam;

a phosphor screen provided on the inner surface of the faceplate for emitting a visible light by bombardment of the electron beam; and, an antistatic layer covering the outer surface of the faceplate, the antistatic layer being formed by using a solution containing an alcoholate of silicon as main constituent and a stabilizing substance present in operative concentrations for maintaining antistatic characteristics of the antistatic layer, wherein antistatic coating contains moisture absorbent present in operative concentrations for promoting antistatic characteristics of the antistatic coating and wherein the moisture absorbent is at least one selected from the group consisting of Li, Ba, Sr and Ca.

6. A cathode ray tube comprising:

an envelope including a face-plate with an inner and outer surfaces and a sidewall portion, a neck, and, a cone connecting the faceplate to the neck;

an electron gun provided inside the neck for emitting at least one electron beam;

a phosphor screen provided on the inner surface of the faceplate for emitting a visible light by bombardment of the electron beam; and, light filtering means provided in front of the faceplate for selectively transmitting light, the light filtering means having maximum absorption wavelength in wavelength range of 575±20 nm in connection with wavelength range form 400 nm to 650 nm and being satisfied with the relationship of $$T_{min} \leqq T_{550} < T_{530},$$

$$1 \leqq T_{450}/T_{530} \leqq 2,$$
$$1 \leqq T_{630}/T_{530} \leqq 2,$$

$$0.7 \leqq T_{450}/T_{630} \leqq 1.43$$

wherein $T_{450}$, $T_{530}$, $T_{550}$, $T_{630}$ and $T_{min}$ represent the transmissivities for lights of wavelength of 450 nm, 530 nm, 550 nm, 630 nm and the maximum absorption wavelength, respectively.

7. A cathode ray tube according to claim 6 wherein the light filtering means is satisfied with the relationship of $T_{650\sim700} < T_{630}$ when the transmissivity for light of the maximum absorption wavelength in the wavelength region from 650 nm to 700 nm is shown as $T_{650\sim700}$.

8. A cathode ray tube according to claim 6 wherein the filtering means comprises a transparent substrate and a filtering layer which covers the substrate and is formed by using a solution containing an alcoholate of silicon as a main constituent and filtering substance present in operative concentration.

9. A cathode ray tube according to claim 8 wherein the substrate of the filtering means is the faceplate.

10. A cathode ray tube according to claim 8 wherein the substrate of the filtering means is a plate provided in front of the faceplate.

11. A cathode ray tube according to claim 8 wherein the filtering substance is xanthene dye.

12. A cathode ray tube according to claim 9 wherein the filtering means has an antistatic characteristics.

13. A cathode ray tube according to claim 6 wherein the filtering means comprises a transparent substrate containing filtering substance present in operative concentration.

14. A cathode ray tube according to claim 6 wherein the filtering means comprises an adhesive resin layer containing filtering substance present in operative concentration and is provided on the outer surface of the faceplate.

* * * * *